US009175905B2

(12) United States Patent
Patel et al.

(10) Patent No.: US 9,175,905 B2
(45) Date of Patent: Nov. 3, 2015

(54) PROCESS FOR SEPARATING AND RECOVERING NGLS FROM HYDROCARBON STREAMS

(76) Inventors: Kirtikumar Natubhai Patel, Sugar Land, TX (US); Rohit N. Patel, N. Wembley (GB)

( * ) Notice: Subject to any disclaimer, the term of this patent is extended or adjusted under 35 U.S.C. 154(b) by 536 days.

(21) Appl. No.: 13/282,407

(22) Filed: Oct. 26, 2011

(65) Prior Publication Data

US 2012/0096895 A1 Apr. 26, 2012

Related U.S. Application Data

(60) Provisional application No. 61/406,633, filed on Oct. 26, 2010.

(51) Int. Cl.
*F25J 3/00* (2006.01)
*F25J 3/02* (2006.01)
(Continued)

(52) U.S. Cl.
CPC ..... *F25J 3/0209* (2013.01); *C10G 5/06* (2013.01); *C10G 70/043* (2013.01); *C10L 3/101* (2013.01); *F25J 3/0233* (2013.01); *F25J 3/0238* (2013.01); *F25J 3/061* (2013.01); *F25J 3/064* (2013.01); *F25J 3/0635* (2013.01); *C10G 2300/1025* (2013.01); *C10G 2300/1033* (2013.01); *C10G 2300/4081* (2013.01); *F25J 2200/02* (2013.01);
(Continued)

(58) Field of Classification Search
CPC ... F25J 1/0045; F25J 2205/04; F25J 2215/02; F25J 2220/64
USPC ..... 62/618, 619, 620
See application file for complete search history.

(56) References Cited

U.S. PATENT DOCUMENTS 3,218,816 A * 11/1965 Grenier ..... 62/630
3,257,813 A * 6/1966 Hashemi-Tafreshi ..... 62/613
(Continued)

FOREIGN PATENT DOCUMENTS

WO 2006026525 3/2006

OTHER PUBLICATIONS

PCT/US2011/057937 (Patel et al.) counterpart to the present application; Notification of the PCT International Search Report (2 pages); PCT International Search Report (ISR)(3 pages); PCT Written Opinion (WO) of the International Searching Authority (4 pages). 9 total pages, all dated Jun. 26, 2012.

*Primary Examiner* — John F Pettitt
*Assistant Examiner* — Tareq Alosh
(74) *Attorney, Agent, or Firm* — Gordon G. Waggett, P.C.

(57) ABSTRACT

This process comprises using unconventional processing of hydrocarbons, e.g. natural gas, for recovering C2+ and NGL hydrocarbons that meet pipeline specifications, without the core high capital cost requirement of a demethanizer column, which is central to and required by almost 100% of the world's current NGL recovery technologies. It can operate in Ethane Extraction or Ethane Rejection modes. The process uses only heat exchangers, compression and simple separation vessels to achieve specification ready NGL. The process utilizes cooling the natural gas, expansion cooling, separating the gas and liquid streams, recycling the cooled streams to exchange heat and recycling selective composition bearing streams to achieve selective extraction of hydrocarbons, in this instance being NGLs. The compactness and utility of this process makes it feasible in offshore applications as well as to implementation to retrofit/revamp or unload existing NGL facilities. Many disparate processes and derivatives are anticipated for its use.

15 Claims, 1 Drawing Sheet

(51) Int. Cl.

| | |
|---|---|
| ***C10G 5/06*** | (2006.01) |
| ***C10G 70/04*** | (2006.01) |
| ***C10L 3/10*** | (2006.01) |
| ***F25J 3/06*** | (2006.01) |

(52) U.S. Cl.

CPC ..... *F25J 2205/04* (2013.01); *F25J 2210/02* (2013.01); *F25J 2210/04* (2013.01); *F25J 2215/02* (2013.01); *F25J 2220/64* (2013.01); *F25J 2235/60* (2013.01); *F25J 2240/02* (2013.01); *F25J 2240/40* (2013.01); *F25J 2245/02* (2013.01); *F25J 2260/20* (2013.01); *F25J 2270/02* (2013.01); *F25J 2270/88* (2013.01); *F25J 2280/02* (2013.01)

(56) References Cited

U.S. PATENT DOCUMENTS

| | | | | |
|---|---|---|---|---|
| 3,721,099 | A * | 3/1973 | Forg et al. | 62/612 |
| 3,901,673 | A * | 8/1975 | Zahn et al. | 62/619 |
| 5,114,451 | A | 5/1992 | Rambo et al. | |
| 5,588,308 | A | 12/1996 | Daugherty et al. | |
| 5,685,170 | A | 11/1997 | Sorensen | |
| 5,992,175 | A | 11/1999 | Yao et al. | |
| 6,014,869 | A | 1/2000 | Elion et al. | |
| 6,116,050 | A | 9/2000 | Yao et al. | |
| 6,209,350 | B1 * | 4/2001 | Kimble, III | 62/613 |
| 6,289,692 | B1 * | 9/2001 | Houser et al. | 62/613 |
| 6,401,486 | B1 | 6/2002 | Lee et al. | |
| 6,453,698 | B2 | 9/2002 | Jain et al. | |
| 6,510,706 | B2 | 1/2003 | Stone et al. | |
| 6,604,380 | B1 | 8/2003 | Reddick et al. | |
| 6,823,692 | B1 | 11/2004 | Patel et al. | |
| 7,010,937 | B2 | 3/2006 | Wilkinson et al. | |
| 7,051,552 | B2 | 5/2006 | Mak | |
| 7,051,553 | B2 | 5/2006 | Mak et al. | |
| 7,159,417 | B2 | 1/2007 | Foglietta et al. | |
| 7,165,423 | B2 | 1/2007 | Winningham | |
| 7,216,507 | B2 | 5/2007 | Cuellar et al. | |
| 7,234,321 | B2 * | 6/2007 | Maunder et al. | 62/613 |
| 7,257,966 | B2 | 8/2007 | Lee et al. | |
| 7,316,127 | B2 | 1/2008 | Huebel et al. | |
| 7,377,127 | B2 | 5/2008 | Mak | |
| 7,631,516 | B2 | 12/2009 | Cuellar et al. | |
| 7,818,979 | B2 | 10/2010 | Patel et al. | |
| 8,528,361 | B2 * | 9/2013 | Nanda et al. | 62/620 |
| 2004/0206112 | A1 | 10/2004 | Mak | |
| 2005/0155382 | A1 | 7/2005 | Ohara et al. | |
| 2005/0204774 | A1 | 9/2005 | Foglietta et al. | |
| 2005/0218041 | A1 | 10/2005 | Yoshida et al. | |
| 2005/0229634 | A1 | 10/2005 | Huebel et al. | |
| 2006/0130521 | A1 | 6/2006 | Patel | |
| 2006/0150672 | A1 | 7/2006 | Lee et al. | |
| 2008/0098770 | A1 | 5/2008 | Ransbarger | |
| 2009/0165498 | A1 | 7/2009 | Mak | |
| 2009/0221864 | A1 | 9/2009 | Mak | |
| 2010/0011809 | A1 | 1/2010 | Mak | |
| 2010/0236285 | A1 | 9/2010 | Johnke et al. | |
| 2011/0226013 | A1 | 9/2011 | Johnke et al. | |
| 2012/0118007 | A1 * | 5/2012 | Qualls | 62/611 |

* cited by examiner

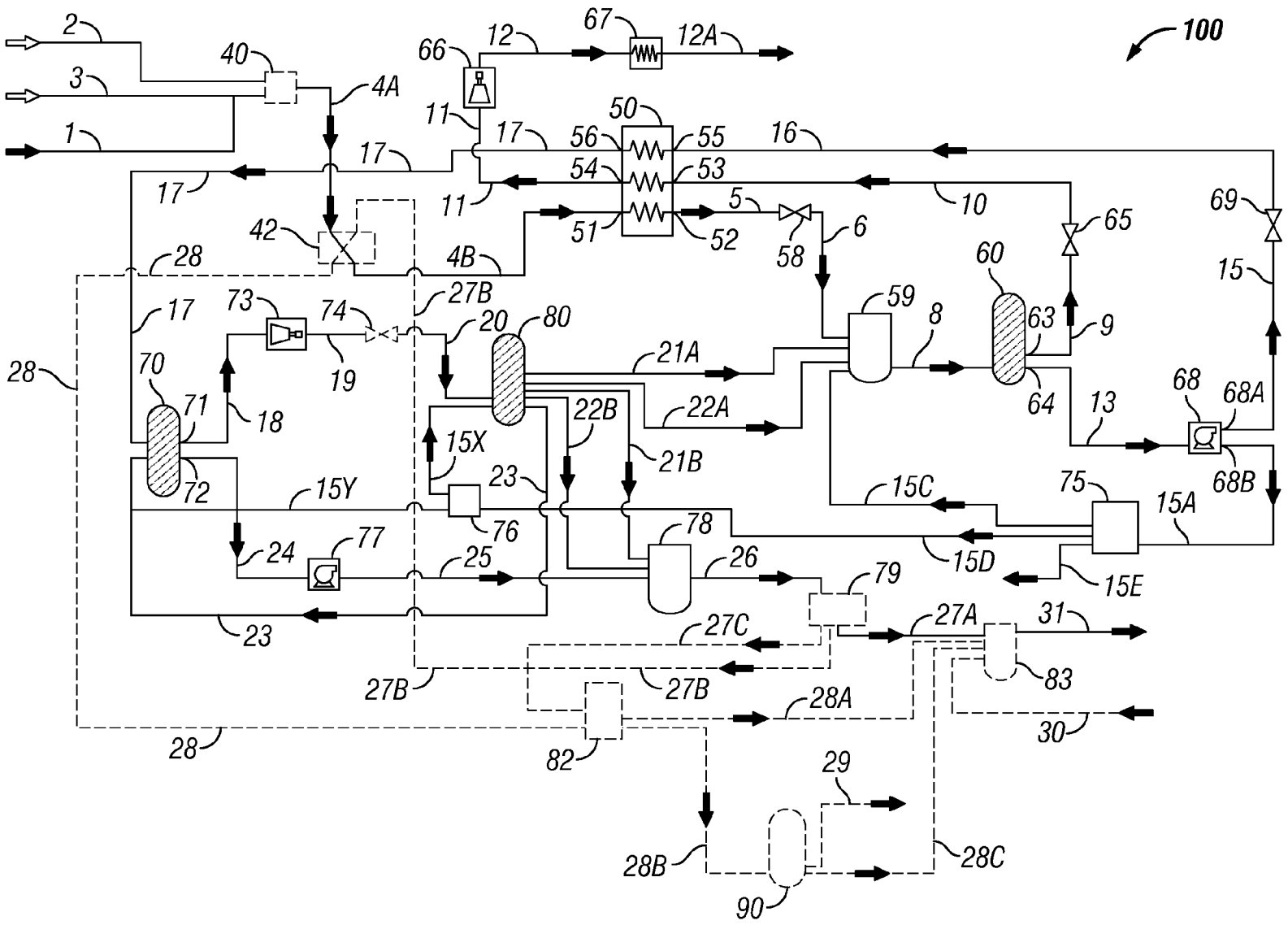
100
1
2
3
4A
4B
5
6
8
9
10
11
12
12A
13
15
15A
15C
15D
15E
15X
15Y
16
17
18
19
20
21A
21B
22A
22B
23
24
25
26
27A
27B
27C
28
28A
28B
28C
29
30
31
40
42
50
51
52
53
54
55
56
57
58
59
60
63
64
65
66
67
68
68A
68B
69
70
71
72
73
74
75
76
77
78
79
80
82
83
90

PROCESS FOR SEPARATING AND RECOVERING NGLS FROM HYDROCARBON STREAMS

CROSS-REFERENCE TO RELATED APPLICATIONS

This application claims the benefit of the filing date of and priority to U.S. Provisional Application Ser. No. 61/406,633 entitled "CO2 Tolerant Deep NGL/LPG (C2+/C3+) RECOVERY; Process/System/Apparatus with options for: Ethane EXTRACTION/REJECTION; Sales Gas/LNG Treatment/GASIFICATION; Elimination/Decoupling/Revamp of DEMETHANIZERS/DEETHANIZERS/Refrigeration; Achieving/Meeting C1/C2 Content and TVP PIPELINE Specs for NGL or HEAVY CRUDE OIL AND/OR VISCOSITY Specs; Option to REDUCE/ELIMINATE De-C1, De-C2 Columns Heating/Cooling/Traffic DUTIES/LOADS; Onsite/Offshore/Plant suitable system for NGL/LPG Extractions" and filed Oct. 26, 2010, Confirmation No. 1012. Said application is incorporated by reference herein.

STATEMENT REGARDING FEDERALLY SPONSORED RESEARCH OR DEVELOPMENT

Not Applicable.

BACKGROUND OF THE INVENTION

The present invention is in the technical field of recovery of less volatile than methane or C1 component recoveries from gas/fluid mixtures in Oil/Gas or Petrochemical operations.

More particularly, in addition the present invention is in the technical field of and applicable to various oil/gas production arenas.

Prior art utilizes complex equipment arrangements and operations for condensate recoveries and generally do not utilize our methods for enhancing upstream operations.

BACKGROUND ART

U.S. Pat. No. 5,685,170 to Sorenson (Nov. 11, 1997) discloses propane recovery processes. Increased recovery of propane, butane and other heavier components found in a natural gas stream is achieved by installing an absorber upstream from an expander and a separator. The separator is downstream from the expander and returns the liquid stream generated by the separator back to the absorber. Additionally, the recovery of propane, butane and other heavier components is enhanced by combining the upper gas stream from a distillation column with the upper gas stream from the absorber prior to injecting this combination into the separator. The upper gas stream removed from the separator is then subsequently processed for the recovery of a predominately methane and ethane gas stream while the bottom liquid stream from the absorber is subsequently distilled for the generation of a stream consisting predominately of propane, butane and other heavy hydrocarbon components. Alternate embodiments include an additional reflux separator in the system, or substitution of an additional absorber for the separator.

U.S. Pat. No. 7,051,552 to Mak (May 30, 2006) discloses configurations and methods for improved NGL recovery as follows: Feed gas (1) in an improved NGL processing plant is cooled below ambient temperature and above hydrate point of the feed gas to condense heavy components (6) and a significant portion of water (4) contained in the feed gas. The water (4) is removed in a feed gas separator (101) and the condensed liquids are fed into an integrated refluxed stripper (104) that operates as a drier/demethanizer for the condensed liquids, and the uncondensed portion (5) containing light components is further dried (106) and cooled prior to turbo expansion (23) and demethanization (112). Consequently, processing of heavy components in the cold section is eliminated, and feed gas with a wide range of compositions can be efficiently processed for high NGL recovery at substantially the same operating conditions and optimum expander efficiency.

U.S. Pat. No. 7,051,553 to Mak, et al. (May 30, 2006) discusses twin reflux process and configurations for improved natural gas liquids recovery: A two-column NGL recovery plant includes an absorber (110) and a distillation column (140) in which the absorber (110) receives two cooled reflux streams, wherein one reflux stream (107) comprises a vapor portion of the NGL and wherein the other reflux stream (146) comprises a lean reflux provided by the overhead (144) of the distillation column (140). Contemplat configurations are especially advantageous in a upgrade of an existing NGL plant and typically exhibit C.sub.3 recovery of at least 99% and C2 recovery of at least 90%.

U.S. Pat. No. 7,377,127 to Mak (May 27, 2008) discusses a configuration and process for NGL recovery using a subcooled absorption reflux process: An NGL recovery plant includes a demethanizer (7) in which internally generated and subcooled lean oil absorbs CO.sub.2 and C.sub.2 from a gas stream (11), thereby preventing build-up and freezing problems associated with CO.sub.2, especially where the feed gas has a CO.sub.2 treatment at ethane recoveries above 90% and propane recoveries of at least 99%.

U.S. Pat. No. 5,992,175 to Yao et al. (Nov. 30, 1999) discusses enhanced NGL recovery utilizing refrigeration and reflux from LNG plants: The present invention is directed to methods and apparatus for improving the recovery of the relatively less volatile components from a methane-rich gas feed under pressure to produce an NGL product while, at the same time, separately recovering the relatively more volatile components which are liquified to produce an LNG product. The methods of the present invention improve separation and efficiency within the NGL recovery column while maintaining column pressure to achieve efficient and economical utilization of the available mechanical refrigeration. The methods of the present invention are particularly useful for removing cyclohexane, benzene and other hazardous, heavy hydrocarbons from a gas feed. The benefits of the present invention are achieved by the introduction to the NGL recovery column of an enhanced liquid reflux lean on the NGL components. Further advantages can be achieved by thermally linking a side reboiler for the NGL recovery column with the overhead condenser for the NGL purifying column. Using the methods of the present invention, recoveries of propane and heavier components in excess of 95% are readily achievable.

BRIEF SUMMARY OF THE INVENTION

To address the forgoing desires, the present invention describes a process using unconventional processing of hydrocarbons, e.g. natural gas, for recovering C2+ and NGL hydrocarbons that meet pipeline specifications, without the core high capital cost requirement of a demethanizer column, which is central to and required by almost 100% of the world's current NGL recovery technologies. It can operate in Ethane Extraction or Ethane Rejection modes. The process uses only heat exchangers, compression and simple separation vessels to achieve specification ready NGL. The process utilizes cooling the natural gas, expansion cooling, separating the gas and liquid streams, recycling the cooled streams to exchange heat and recycling selective composition bearing streams to achieve selective extraction of hydrocarbons, in this instance being NGLs. The compactness and utility of this process makes it feasible in offshore applications as well as to implementation to retrofit/revamp or unload existing NGL facilities. Many disparate processes and derivatives are anticipated for its use.

The present disclosure describes a different and novel approach to NGL and such condensate production versus the predominant current art technologies in this field. The present disclosure can eliminate requirements for a demethanizer completely and/or at least de-couple it from the process so that it acts as a polishing demethanizer with reduced loads and/or higher recoveries of C2+/C3+ components as required and in variable and flexible recoveries. The present invention uses a unique combination of expansion/separation/compression sequences to achieve what normally would require a complex demethanizer column of a large cost to do the same duty of demethanization and the NGL extraction. The current invention can further provide deep extraction of C2+ components of interest with use of either JT or Turbo or JT/Turbo-Expanders and their various configurations. The present invention can be optimized and/or configured in many flexible ways to compete with current art technologies with CAPEX/OPEX savings. It can take gas source pressures of a wide range as long as the combinations of the composition and cooling/expansion cooling combinations meet the recovery mode of operation.

Turbo expander units can be substituted by vortex based or sonic based condensate producing units wherever we need expansion cooling or pre-cooling for condensate extractions.

The present disclosure provides an NGL/LPG/LNG process and disclosure of method/process/system/apparatus of invention to provide simplified cooling and deep extraction of C2+/C3+ components from a gas/mixture. The present disclosure provides a process suitable to be part of an LNG/GAS pre- or post-pretreatment.

The present disclosure provides a process for controlling compositions of various fractions that are separated and at same time while also being able to meet where required <0.5% vol of C1 (methane) content for NGL pipeline specification.

Further the present disclosure provides a process or method that can provide elimination/enhancement/revamp and/or de-coupling of the integrated/coupled demethanizer/deethanizer/fractionator columns from the current art and practice of NGL/LPG/LNG process systems. It is contemplatee with this process a reduction/elimination of demethanizer/deethanizer cooling/heating/traffic duties and loads. It is also contemplated with this process or method deeper and $CO_2$ tolerant variable ethane extraction/rejection mode operations.

It is also contemplated deep NGL extraction with option to vary content to meet crude oil spike/spiking requirements for TVP (True Vapor Pressure)/pumping specifications/requirements.

This process may be employed with the option to vary the content of NGL condensate and blending with very high viscosity crudes to modify their properties for easier handling and/or to meet crude oil spike/spiking requirements for TVP (True Vapor Pressure)/pumping specifications/requirements.

With use of the present invention, it is contemplated that the elimination/reduction/enhancement of external/attached refrigeration system needs in NGL/LNG/GAS production systems will be achieved.

The present disclosure also provides for dehydration/dew-point/HHV control of export/sales/residue/reinjection/re-gasified LNG. The present disclosure also teaches addition/reduction HHV/HV (High Heating Value/Heating Value) control of gas streams in pipelines or pipeline network systems. This process/method provides a producer/carrier/pipeline system onsite/offshore/plant suitable system for NGL/LPG/LNG processes.

The present disclosure also provides LNG pretreatment/post-treatment/integration for/in LNG production/re-gasification systems; possible bulk removal of $H_2S$ and/or $CO_2$.

Additionally, use of this invention provides a means of modifying heavy crude oil properties to make it less viscous or of higher API or modification other properties to make it more suitable for processing/handling.

In one embodiment of the present invention there is described a process for separating less volatile hydrocarbons from more volatile hydrocarbons comprising the steps of: (a) providing a pressurized feedstock stream comprising hydrocarbons C1, C2, C3+; (b) cooling the feed stream in an LNG heat exchanger; (c) further cooling the feed stream from the heat exchanger via a first gas expansion assembly; (d) separating the further cooled stream in a first gas/liquid separation vessel assembly into gas and liquid streams; (e) pumping the liquid stream (0-100%) from the first separation vessel assembly into the heat exchanger to impart a cooling effect on the feed stream in the heat exchanger; (f) recycling the gas stream from the first separation assembly into the heat exchanger to impart a cooling effect on the feed stream in the heat exchanger; (g) directing the recycled gas stream from the heat exchanger to a first compressor cooler assembly, and then compressing and cooling such gas for use at a desired location; (h) directing the recycled liquid stream from the heat exchanger to a second separation assembly wherein gas and liquid are separated; (i) directing the gas stream from the second separation assembly to a second compressor cooler assembly and compressing such gas stream; (j) cooling the gas stream from the second compressor cooler assembly via a second gas expansion assembly; (k) directing the cooled stream from the second gas expansion assembly to a third separation vessel assembly; (1) recycling the gas stream (0-100%) from the third separation vessel assembly to the first separation vessel assembly; (m) recycling the gas stream (0-100%) from the third separation vessel assembly to a first stream mixer splitter assembly; (n) recycling the liquid stream (0-100%) from the third separation vessel assembly to the first separation vessel assembly; (o) recycling the liquid stream (0-100%) from the third separation vessel assembly to the first stream mixer splitter assembly; (p) recycling the liquid stream (0-100%) from the third separation vessel assembly to the second separation vessel assembly; (q) pumping the liquid stream from the second separation vessel assembly to the first stream mixer splitter assembly; (r) directing the stream (0-100%) from the first stream mixer splitter assembly to a mixing blender or other desired end location; (s) directing the stream (0-100%) from the first stream mixer splitter assembly to a second stream mixer splitter assembly; (t) directing the stream (0-100%) from the second stream mixer splitter assembly to the mixing blender or other desired location; (u) pumping the liquid stream (0-100%) from the first separation vessel assembly into a third stream splitter; (v) directing the liquid stream (0-100%) from the third stream splitter to the first separation vessel assembly; (w)directing the liquid stream (0-100%) from the third stream splitter to a fourth stream splitter; (x) directing the liquid stream (0-100%) from the third stream splitter to a desired location; (y) directing the liquid stream (0-100%)

from the fourth stream splitter to the third separation vessel assembly; (z) directing the liquid stream (0-100%) from the fourth stream splitter to the second separation vessel assembly; and (aa) directing the liquid products from the mixing blender to a desired location.

The various streams, as indicated above, may be directed to one or more locations, and thus, can vary between 0% and 100% depending on desired operational parameters. For example, in one of the recycle streams, 0% would indicate that this step was optional and might not be required in that particular mode of operation. In operational configurations where certain options are not needed, it will be understood that the process need not be required to have a facility for such option. To provide the greatest amount of operational flexibility, it will also be understood that a facility might be equipped to have all of the options available whether all such options are used or not.

The hydrocarbon feedstock may comprise a hydrocarbon-containing gas, such as natural gas. In one embodiment, the feed stream is pre-cooled in a pre-cooling assembly prior to the step of cooling in the heat exchanger. When a pre-cooling assembly is used, the process may comprise the further steps of first directing the stream (0-100%) from the first stream mixer splitter assembly to the pre-cooling assembly to provide a cooling duty to the pre-cooling assembly and then directing this stream to the second stream mixer splitter assembly. The pre-cooling assembly may obtain its cooling duty from an external refrigeration source. The heat exchanger may comprise one or more heat exchangers operating together. In one embodiment the steps of expansion are accomplished using expansion devices selected from the group consisting of: valves, turbo expanders, vortex devices, and sonic devices and the like.

One such option includes the further steps of: (i) directing the stream (0-100%) from the second stream mixer splitter assembly to one or more process columns; (ii) processing this stream in the one or more process columns; (iii) directing the processed product liquid stream from the one or more process columns to the mixing blender or other desired end location; and (iii) directing any residue streams from the one or more process columns to a desired location.

Another option includes the further steps of: (i) introducing a source of crude oil or other liquid hydrocarbons into the mixing blender; and (ii) blending the crude oil with the liquid products from the process that are present in the mixing blender.

In one embodiment, the feedstock is pressurized to between about 300 psig to 1200 psig. In another embodiment, the feedstock is pressurized to about 500 psig.

In another embodiment of the present invention the first gas expansion assembly comprises a first turbo expander, and the process comprises the additional steps of: after the step of separating the further cooled stream in a first gas/liquid separation vessel assembly into gas and liquid streams, directing the gas stream into a second turbo expander, and then separating the stream from the second turbo expander into a gas stream and an additional liquid stream, the additional liquid stream being directed as per the liquid stream from the first separation vessel assembly.

BRIEF DESCRIPTION OF THE DRAWINGS

FIG. 1 is a flow diagram of a HYSYS Simulation of a gas processing plant in accordance with the present invention.

DETAILED DESCRIPTION OF THE INVENTION

Referring to FIG. 1, there is shown an exemplary flow diagram of a gas processing plant 100 employed to knock out NGLs from various gas feedstock streams 1, 2 and/or 3. FIG. 1, in connection with the TABLES set forth below, provide detail indicative of the overall inventions. The feedstock streams 1, 2 and/or 3 are directed (through suitable conduit) into feed stream 4A. Feedstock stream 1 represents a pressurized feedstock gas/fluid stream that is lean in C2+ content. Feedstock stream 2 represents a pressurized feedstock gas/fluid stream that is rich in C2+ content. Feedstock stream 3 represents a pressurized feedstock gas/fluid stream that is mid-level in C2+ content. The pressurized feedstock gas streams may originate from any source of natural gas or hydrocarbon-containing gas. For example, feedstock streams 1, 2, 3 may comprise, for example, natural gas from gas pipelines, natural gas from gas production, natural gas from oil and gas production facilities, and other hydrocarbon-containing gas streams. The pressure of the feedstock streams may be regulated and variable, to provide suitable pressure to drive the process. One such suitable pressure is 916 psig as shown in one of the examples relating to feedstock stream 1.

Feedstock streams 1, 2 and/or 3 (or a combined feedstock stream 4A) may optionally first be cooled by passing it/them through a cooler 40 equipped with desired modes of cooling/refrigeration equipment.

Stream 4A/4B is directed to a heat exchanger 50 (LNG exchanger, cold box, or other arrangement to achieve exchange of heat). However, prior to entry into the LNG heat exchanger 50, stream 4A is directed through a cross exchanger 42 where it is cooled by cross exchange with the product NGL streams 27B and/or 28 from later downstream stages of the process. The cooled stream 4B emerges from cross exchanger 42 and is directed into a first entry port 51 into heat exchanger 50 wherein stream 4A is cooled via cross exchange with other process streams 10, 16 and exits exchanger through first exit port 52 as cooled stream 5. Cooled stream 5 is then directed through valve or first gas expansion assembly 58 (or optional via turbo expansion/vortex/sonic expansion/separation units) to release pressure, wherein the emerging gas stream 6 cools via expansion prior to entering a mixer 59 where it can be mixed with other process streams 21A and/or 22A and/or 15C as may be directed into the mixer 59. V The cooler 40 and cross exchanger 42 may be a combination unit or otherwise interface together in what is referred to as a pre-cooling assembly.

The mixed gas stream (with any liquid phase present) within mixer 59 is then directed as mixed stream 8 to a gas/liquid separator 60. The mixer 59 and separator 60 may be a combination unit or otherwise interface together in what is referred to as a first separation vessel assembly. The resulting vapor stream 9 emerges through separator gas outlet 63 and is transferred through valve 65 where it becomes stream 10. As noted above, vapor stream 10 is fed into the second entry port 53 of exchanger 50 where it becomes heated (via exchange of its cold energy to cool the warm feed stream 4B) and emerges as heated or warmed gas stream 11 while stream 4B emerges as cooled stream 5. As discussed further below, the heat exchanger 50 also introduces cool stream 16 to provide further cooling of feed stream 4B, while also warming stream 16.

Warmed gas stream 11 is then directed into gas compressor 66 where it is compressed into residual compressed gas stream 12. Compressed gas stream 12 is cooled in exchanger 67 where it leaves as compressed residue gas stream 12 and is directed to a desired location. Gas compressor 66 and exchanger 67 can work separately or together as part of an integral unit also referred to as the first compressor cooler assembly.

Liquid in gas/liquid separator 60 emerges from separator liquid outlet 64 as liquid stream 13 and is directed to a pump 68. From pump 68, the liquid stream 13 is directed through pump outlet 68A to become stream 15 which is then directed through an optional valve 69 to the third entry port 55 of exchanger 50 where liquid or partial liquid stream 16 cross exchanges along with stream 10 to further impart composite "cold energy" to cool feed stream 4B and then emerges from exchanger 50 through the third exit port 56 as warmed stream 17. As discussed below, stream 13 may optionally be split to permit liquid to be directed out pump outlet 68B as stream 15A to other parts of the process.

Warmed stream 17 is then fed to a separator vessel (second separation vessel assembly) 70 with other recycle streams 23, and 15Y. Vapor stream 18 emerges from separator vessel 70 through vessel vapor outlet 71 and is directed to gas compressor/cooler arrangement 73 to become stream 19. Stream 19, in turn, is fed via optional valve (or second gas expansion assembly) 74 as stream 20 to third separation vessel assembly 80. Gas compressor 73 and valve 74 can work separately or together as part of an integral unit also referred to as the second compressor cooler assembly. Additional recycle stream 15X also enters vessel 80 to mix with stream 19.

Referring back to separator 60, liquid stream 13 may optionally be split in pump 68 to permit liquid to be directed out pump outlet 68B as optional split stream 15A. Stream 15A is then directed to a splitter (also called third stream splitter) 75 where stream 15A may be optionally split into one or more recycle streams 15C, 15D, and/or 15E as desired to play a role in the C2 extraction and other overall NGL recovery performance mode. Optional split stream 15C is recycled back to mixer 59 for use in feeding separator 60 (or stream 15C can be directed directly back to separator 60). Optional liquid stream 15E may be directed to any desired location, including being introduced as a reflux stream into optional processing column 90 discussed below (which can be a demethanizer, deethanizer, depropanizer or any combinations thereof) to polish or otherwise extract other products present in the stream. Optional recycle stream 15D is fed to splitter (also called fourth stream splitter) 76 where one optional emerging stream 15X may be fed into separation vessel assembly 80 as noted above, and/or another optional emerging stream 15Y may be fed into separator 70 as noted above.

Referring back to separation vessel assembly 80, as noted above, vessel 80 receives stream 20 and optionally stream 15X. Liquid and gas in vessel 80 may be fed into other parts of the process. For example, liquid from vessel 80 may be optionally recycled back to separator 60 via liquid stream 22A through mixer 59 and stream 8 and/or optionally recycled back to separator vessel 70 via liquid stream 23.

Liquid in separator vessel 70 is directed through separator vessel liquid outlet 72 through pump 77 to mixer 78. As an additional option, liquid from vessel 80 may also be diverted towards the liquid product stream 25 via liquid stream 22B into mixer 78.

Gas stream from vessel 80 may optionally be diverted in whole or in part to the separator vessel 60 via stream 21A, mixer 59, and stream 8, and/or may optionally be spiked into the product stream 25 via gas spike stream 21B into mixer 78.

As noted above, mixer 78 may receive liquid streams from separator 70, vessel 80 and a spike gas stream also from vessel 80. The stream emerging from mixer 78 is in turn directed as raw product stream 26 to splitter 79. The mixer 78 and first splitter 79 may operate as an integrated unit referred to as the first stream mixer splitter assembly. From splitter 79, the raw product stream 26 can be directed to an end use location via stream 27A, through receiving vessel 81 and then out as end product NGL-OIL stream 31. Stream A26 can be of sufficient demethanized composition by the present process herein that it can be transferred/diverted as stream 27A to the product or oil-spiking-blending of the process to lead off as NGL-OIL product stream 31.

It is contemplated in this mode of further inventive step to handle and process heavy crude oils by modifying their properties by integrating or coupling or joining operation of the present process with modes of blending and modifying the crude oil properties as indicated in this embodiment—namely as shown in this example but not limited to, where it modifies a 19.65 API Crude Oil of viscosity 39.96 cP to a 25.62 API Crude and 22.557 cP viscosity and still keep the crude to pipeline pumping vapor free conditions—TVP of 44.4 PSIG—whereas pipeline pressures of up to 500 psi can allow even further flexibilities of spiking the crude. The flow proportions to attain the shown example can be referred to by reference to the included TABLE 2 and TABLE 1C.

From splitter 79, the raw product stream 26 can also be recycled, via stream 27B back through heat exchanger 42 where its stream can serve to partially cool the feed stream 4A and thereafter be warmed before being directed, via stream 28 directly to product storage or crude oil blending (such as through second stream mixer splitter assembly 82), then through stream 28A, into mixing blender 83 and then to end product NGL-OIL stream 31). Crude stream 30 can be fed into blender 83 to mix with the product stream 28A. Stream 28 can also be optionally diverted, in whole or in part, through splitter 82 as stream 28B which can then be directed to a demethanizer or polisher column 90 or other columns which can further process or polish the stream 28B prior to becoming the final product stage stream 28C/blender 83/NGL-OIL stream 31, and column overhead or residual streams from column 90 area can via stream 29 become integrated to other process stages (not shown). In the present invention, the column 90 is a simple column that is not entwined into the system, but rather, acts simply to distill the product as an optional polishing step. Demethanizers of the prior art are intrinsically tied to and central to these prior art processes.

Although mixing blender 83 is described as being present to receive various streams from the process prior to discharging to the end product stream 31, it will be understood that the blending step of the process is optional if no crude oil is provided via inlet 30, and therefore, the streams 27A, 28A and 28C may also optionally be directed directly to a desired end location rather than going through blender 83.

Further, as an intent to aid prior art i.e. revamp/capacity-boost prior art, this "prior art" may be used in place of column 90 to which stream 26 can be diverted to—i.e. there exists a market for revamp of capacity.

The raw product stream 26 is of most interest in the present disclosure as it is the product that is demethanized to various levels in various modes of operation of the above configuration, ranging from NGL with total demethanizer equivalent demethanization, larger NGL recovery partial demethanization, C2 Recovery Mode lesser but substantial demethanization. For example, in its such modes of operation the raw product stream 26 can also be sent to a demethanizer or polishing column 90 directly.

There are various junctions depicted in FIG. 1. A junction can mean any combinations of splitter/diverter/mixers and any separate numbers of them within the "junction". To follow track of stream 26 diverted to column 90: Stream 26 goes to and at junction/splitter 79. It can be diverted (0-100%) to Stream 27A—to mixing blender 83—as a PRODUCT NGL; it can be diverted (0-100%) to Stream 27B—to exchanger 42—for "Cool" Recovery in optional exchanger 42—i.e. cooling the feed; it can be diverted (0-100%) to Stream 27C—to junction/splitter 82—for diverting to colum 90.

At junction/splitter 82: optional Stream 28 and/or 27C enter; Streams 28 and/or 27C in combination or severally leave (0-100%) as Stream 28B and/or leave as (0-100%) as Stream 28A (NGL Product). Stream 28B goes to optional column 90 for "polishing" processing; Column 90 produces NGL Product Stream 28C and an overhead or other Stream named 29 (which can be sent to a destination within the main process or any other desired location).

Regarding pressured Stream 1 (LEAN), there is an optional exchanger 40 that may employ external refrigeration/cooling sources. The sequence of placement can vary in relation to exchanger 42 and heat exchanger 50 by choice/optimization. For example, Stream 1-LEAN enters a port in the cooler 40 arrangement. It undergoes cooling in cooler 40 against any source of cooling. Stream 4A leaves cooler 40 as a cooled stream. The cooler 40 operation can be combined in any combination with or within cross exchanger 42 or exchanger 50 which can be similarly combined with or within same equipment in any combination as one example being a multi-pass/multi-stream exchanger.

Cross exchanger 42 is an optional piece of equipment that operates as a heat/cool recovery exchanger. The sequence/combination of placement can vary in relation to cooler 40 and exchanger 50 by choice/optimization and with or within same equipment in any combination as one example being a multi-pass/multi-stream exchanger. For example, Stream 4A enters a port in cross exchanger 42 and undergoes cooling against any source of cooling (Stream 27B in this case), and leaves as Stream 4B via a port as a cooled stream. The cooling Stream A27B enters cross exchanger 42 via a port and leaves as Stream 28 after imparting cooling on Stream 4A. The cross exchanger 40 operation can be combined in any combination with or within cooler 40 or exchanger 50 which can be similarly combined with or within same equipment in any combination as one example being a multi-pass/multi-stream exchanger.

With respect to heat exchanger 50, its sequence/combination of placement can vary in relation to cooler 40 and cross exchanger 42 by choice/optimization and with or within same equipment in any combination as one example being a multi-pass/multi-stream exchanger and others being network/bank of other typical exchangers. Here, Stream 4B enters a port 51 in heat exchanger 50 and undergoes cooling against any source(s) of cooling (Streams 10 and 16 in this case), and leaves as Stream 5 via a port 52 as a cooled stream. The cooling Stream 10 enters the heat exchanger 50 via a port 53 and leaves as Stream 11 via port 54 after imparting part of composite (combined) cooling on Stream 4B. The cooling Stream 16 enters the heat exchanger 50 via a port 55 and leaves via port 56 as Stream 17 after imparting part of composite (combined) cooling on Stream 4B. The heat exchanger 50 operation can be combined or separated and configured in any combination including use of other streams or sources of cooling which will achieve similar or derivative intent of cooling Stream 4B in one or more equipment, as in one example here being a multi-pass/multiport/multi-stream exchanger.

Valve 58 may be a JT valve or turbo expander assembly (or vortex or sonic technology devices and the like) to provide expansion cooling. In this case, Stream 5 enters a port in valve 58 and undergoes pressure drop and leaves as Stream 6 via a port. The stream is cooled by pressure drop and expansion thermodynamics. Where a turbo expander is used the turbo power can be utilized/integrated to other use.

Mixer 59 is another junction. Stream 5 enters a port in mixer 59. Stream 21A, an anticipated vapor stream from separation vessel assembly 80, enters a port of mixer 59. Stream 22A, an anticipated liquid stream from vessel 80 enters a port in mixer 59. Optionally, an anticipated liquid Stream 15C from junction/splitter 75 enters a port in mixer 59. Stream 8 leaves mixer 59 as a mix via a port as Stream 8.

Downstream of mixer 59 is separator vessel 60. Stream 8 enters a port in separator 60. Stream 9 leaves separator 60 (out port 63) as an anticipated gas Stream 9 and then enters a port in valve 65. Stream 13 leaves vessel 60 (via port 64) as an anticipated liquid stream and enters a port in pump 68.

Valve or turbo expander assembly 65 provides pressure control upstream and downstream. In this case, Stream 9 enters a port in valve 65 and leaves as Stream 10 via a port as a stream for providing cooling in the heat exchanger assembly 50. Where a turbo expander is utilized the turbo power can be utilized/integrated to other use.

Pump 68 also serves as a junction. Here, Stream 13 enters a port at pump 68; Stream 15, an anticipated liquid stream from pump 68 leaves via a port to a port on valve 69. Optional Stream 15A, an anticipated liquid stream from pump 68 leaves via a port to a port on splitter/junction 75.

Valve or turbo expander assembly 69 provides pressure control upstream and downstream. Here, Stream 15 enters a port in valve 69 and leaves as Stream 16 via a port as a stream for providing cooling in the heat exchanger 50 assembly. Where a turbo expander is utilized the turbo power can be utilized/integrated to other use.

Emerging from the heat exchanger 50, composite (combined) warmed Stream 11 enters a port at gas compressor 66. Composite (combined) warmed Stream 17 enters a port at separator vessel 70.

With respect to separator vessel 70, anticipated Stream 17 from heat exchanger 50 enters a port at separator vessel 70. Anticipated liquid Stream 23 from separation vessel assembly 80 enters a port at vessel 80. Optional anticipated liquid Stream 15Y from junction/splitter 76 enters a port at separator vessel 70. Stream 18 leaves separator vessel 70 as an anticipated gas stream and enters a port at gas compressor 73. Stream 24 leaves separator vessel 70 as an anticipated liquid stream and enters a port at pump 77.

With respect to compressor and cooler assembly 73, anticipated Stream A18 from separator 70 enters a port at compressor/cooler 73. Stream 18 is compressed and cooled and leaves as compressed cooled Stream 19 from a port of compressor/cooler assembly 73. Compressed Stream 19 from compressor/cooler 73 enters a port at valve 74.

Valve or expander/compressor assembly 74 provides pressure control upstream and downstream. Here, stream 19 enters a port in valve 74 and leaves as Stream 20 via a port. Where a turbo expander is utilized the turbo power can be utilized/integrated to other use.

Separation vessel assembly 80 also serves as a junction assembly. Here, anticipated Stream 20 from valve 74 enters a port at vessel 80. Stream 21A leaves vessel 80 at a port as an anticipated gas stream and enters a port at mixer 59. Anticipated liquid Stream 23 leaves a port at vessel 80 and enters a port at separator 70. Optional anticipated Stream 15X from junction/splitter 76 enters a port at vessel 80. Optional anticipated liquid Stream 22A leaves a port at vessel 80 and enters a port at mixer 59. Optional anticipated liquid Stream 22B leaves a port at vessel 80 and enters a port at mixer 78. Optional anticipated vapor Stream 21B leaves a port at vessel 80 and enters a port at mixer 78 (for further anticipation of sending to column 90 if desired).

Regarding pump assembly 77, Stream 24 enters a port at pump 77. Stream 25, an anticipated liquid stream from pump 77 leaves via a port to port on mixer 78.

Regarding mixing junction 78, Streams (and Optional Streams) (25, 22B, 21B enter mixing junction 78 via ports. Stream 26 (anticipated raw NGL product) leaves mixer 78 via a port to enter splitting junction 79 at a port.

Regarding splitter junction 79, Stream 26 (anticipated raw NGL Product) enters splitter 79 at a port. Stream 27A leaves splitter 79 as Stream 27A (essentially raw NGL Product). As an option, 0-100% of flow of splitter 79 departing streams, anticipated Stream 27B leaves splitter 79 to enter exchanger 42 as a heat exchange stream, imparting any cooling duty available to exchanger 42. As an option, 0-100% of flow of splitter departing streams, anticipated Stream 27C leaves a port at splitter 79 and enters a port at splitter junction 82.

With respect to optional junction 82, as one option, Stream (0-100% of flow of splitter 79 departing streams) 27C (anticipated raw NGL Product) enters splitter 82 at a port. As another option, Stream (0-100% of flow of splitter 79 departing streams) 28 leaving exchanger 42 enters a port at splitter 82 (essentially raw NGL Product). Anticipated Stream 28A leaves splitter 82 to enter end product mixer 83. As an option, Stream 28B leaves a port at splitter 82 and enters a port at column 90 (an anticipated polishing/extracting equipment such as a demethanizer or other anticipated assembly of other refining equipment).

Column 90 is an optional polishing/extracting equipment such as a demethanizer or other anticipated assembly of other refining equipment). As an option, Stream 28C leaves a port at column 1 and enters a port at end product mixer 83. Anticipated Stream(s) 29 leave column 90 to enter the Process for recouping some overhead components or can leave to any desired destination;

The end product mixer, 83 is anticipated to accept at ports Streams (and optional Streams) (27A, 28A, 28*c*, "30 (CRUDE)", etc.) and exit as Stream "31 NGL-OIL"by pumping and/or mixing with other product Liquids (such as heavy crude oils, but not limited to) of which it is anticipated of this invention as one part to provide feasibility or function. It is also anticipated that Stream "31 NGL-OIL" is just the product of this process where no mixing of other streams or products is anticipated.

With respect to splitter junction 75, optionally, between 0-100% of flow of pump 68 departing streams), anticipated Stream 15A enters splitter junction 75 at a port. Stream 27A leaves splitter 79 as Stream 27A (essentially raw NGL Product). Optionally, (0-100% of flow of splitter 75 departing streams), anticipated Stream 15C leaves splitter 75 to enter mixer 59. As another option, 0-100% of flow of splitter 75 departing streams), anticipated Stream 15D leaves junction 75 to enter splitter 76. Another option includes (0-100% of flow of junction 75 departing streams), anticipated Stream 15E leaves splitter 75 to enter a desired location for one example as an anticipated reflux to Column 90 area/equipment.

Splitter junction 76 takes on various product streams. For example, optionally (0-100% of flow of splitter 75 departing streams), anticipated Stream 15D enters splitter 76 at a port. Optionally (0-100% of flow of splitter 76 departing streams), anticipated Stream 15X leaves splitter 76 to enter separation vessel assembly 80. Optionally, (0-100% of flow of splitter 76 departing streams), anticipated Stream 15Y leaves slitter 76 to enter separator 70.

Regarding the compressor and cooler system assembly 66, anticipated Stream 11 from heat exchanger 50 enters a port of anticipated Compressor assembly 66 which provides gas to "Residue Gas" Compressor of system 66.

Gas of Stream 11 anticipated is compressed at compressor 66 and leaves a port to enter a port at heat exchanger 67 to be cooled down to anticipated pipeline or transfer pressure and temperature and departing from a port as anticipated gas Stream 12A.

For a better understanding of the operation of the present invention, reference is made to the following Tables in connection with process flow diagrams illustrated in the drawings.

As a means of the explanation of FIG. 1, tables are provided giving more detailed data description of the parameters for the design and operation of the process plant. It will be apparent to one skilled in the art having the benefit of the present disclosure, that the present invention could be practiced by following the present disclosure of the diagrams/Figures and the accompanying data Tables. The current disclosure is indicative of reasonable assumptions typically made by those skilled in the art, including rounding of the data, ambient conditions and heat losses not accounted and not shown but contemplated where required.

Referring now to the invention in more detail, in FIG. 1 (with reference to the Tables) there are provided temperature and pressure profiles as part of the drawings and referring stream table data. This information provides one of ordinary skill in the art of HYSYS Process Simulation with a description of the invention to permit the practice thereof. It is much more elucidating and so one is referred to the Stream Table TABLE 2 for FIG. 1C included herein to view the process parameters of flows, Pressure and Temperature that pertain to each point of process streams referred to in the description below. Other embodiments are variants and/or variables of that.

TABLE 1A

| Stream Name | 4B | 26 | 28B | 31 (NGL-OIL) | 30 (CRUDE) |
|---|---|---|---|---|---|
| Temperature [F.] | 55.057 | 10.039 | 90.000 | 60.000 | 60.000 |
| Pressure [psig] | 906.000 | 400.000 | 300.000 | 495.000 | 500.000 |
| Molar Flow [lbmole/hr] | 25,804.103 | 3,083.124 | 3,082.104 | 2,527.139 | 0.000 |
| Viscosity [cP] | 0.013 | 0.104 | | 0.095 | 29.949 |
| Comp Mole Frac (H2O) | 0.000 | 0.000 | 0.000 | 0.000 | 0.000 |
| Comp Mole Frac (Nitrogen) | 0.000 | 0.000 | 0.000 | 0.000 | 0.000 |
| Comp Mole Frac (CO2) | 0.007 | 0.016 | 0.016 | 0.020 | 0.000 |
| Comp Mole Frac (H2S) | 0.000 | 0.000 | 0.000 | 0.000 | 0.000 |
| Comp Mole Frac (Methane) | 0.873 | 0.129 | 0.129 | 0.008 | 0.000 |
| Comp Mole Frac (Ethane) | 0.071 | 0.444 | 0.444 | 0.487 | 0.000 |
| Comp Mole Frac (Propane) | 0.029 | 0.242 | 0.242 | 0.280 | 0.001 |
| Comp Mole Frac (i-Butane) | 0.005 | 0.042 | 0.041 | 0.050 | 0.001 |
| Comp Mole Frac (n-Butane) | 0.010 | 0.085 | 0.085 | 0.103 | 0.001 |
| Comp Mole Frac (i-Pentane) | 0.002 | 0.015 | 0.015 | 0.018 | 0.006 |
| Comp Mole Frac (n-Pentane) | 0.003 | 0.028 | 0.028 | 0.034 | 0.043 |

TABLE 1A-continued

| Stream Name | 4B | 26 | 28B | 31 (NGL-OIL) | 30 (CRUDE) |
|---|---|---|---|---|---|
| Comp Mole Frac (C6*) | 0.000 | 0.000 | 0.000 | 0.000 | 0.057 |
| Comp Mole Frac (C7*) | 0.000 | 0.000 | 0.000 | 0.000 | 0.804 |

The results from the simulation of TABLE 1A in connection with FIG. 1 can be tabulated as follows:

| EXAMPLE 1A RESULTS | | |
|---|---|---|
| C2 RECOVERY | 67.03 | |
| C3 RECOVERY | 93.78 | |
| FEED C1 MFR | 0.8725 | |
| CRUDE FEED API | 22.47 | API_60 |
| CRUDE VOL FLOW | 0 | barrel/day |
| CRUDE VISCO | 29.9491 | cP |
| PROD API | 158.9 | API_60 |
| PROD VISCO | 0.0951 | cP |
| PROD FLOW | 14465 | barrel/day |
| VOL FR C1-PROD | 0.0048 | |

The characteristics for stream 31 NGL-OIL from the simulation of TABLE 1A in connection with FIG. 1 can be tabulated as follows:

| EXAMPLE 1A 31 (NGL-OIL) | |
|---|---|
| 60.00 | ° F. |
| 495.0 | psig |
| 414.3 | psig |
| 0.0951 | cP |

The characteristics for stream 30 crude from the simulation of TABLE 1A in connection with FIG. 1 can be tabulated as follows:

| EXAMPLE 1A 30 (CRUDE) | |
|---|---|
| 60.00 | ° F. |
| 500.0 | psig |
| −11.95 | psig |
| 0.0000 | barrel/day |

-continued

| EXAMPLE 1A 30 (CRUDE) | |
|---|---|
| −11.47 | psig |
| 29.95 | cP |

TABLE 1A (in conjunction with the process flow diagram of FIG. 1) shows NGL recovery utilizing demethanizer column 90 for polishing recovery. In this example, there is 12.9% C1 in the raw NGL product. After the column 90, there is demonstrated C2 recovery of 67.03% and C3 recovery of 93.78%. TABLE 1A shows partial achievement of demethanizing while extracting NGL—"partial" is deliberate for ethane extraction—using the present process, and then polishing it with a demethanizer.

By way of summary of the example set out in connection with TABLE 1A and FIG. 1, there is no oil used. Product stream is diverted to further treat in column. Using some of the variability of the system functions to produce NGL already down to C1=/<12.9% Mole. In this example, there is no no flow of Crude Oil Stream (0.000 "Molar Flow" flow in "30 (CRUDE)"). Stream "31 (NGL-OIL)" is either just the NGL product or blended with oil final product either as: straight from the inventive process (called raw NGL and as in Stream 26). The Cl content is approximately down to 12.9% or is diverted via Stream 28B to a polishing/column facility 90 (a de-methanizer column or other facility) producing NGL product of required specifications (e.g. in this case <1% Mole C1).

With this example, the overall performance accomplished is:

C2 Recovery of 67%

C3+ Recovery of 94%+

NGL Prod demethanized to <0.5% vol. C1 using column facility.

Blended with Oil (Not applicable in this example).

Blending with crude oil for any number of purposes e.g. but not limited to:

Modifying Crude Oil viscosity From X cP to Z cp)

Blending (Spiking) as a recovered product from gas stream.

TABLE 1B

| Stream Name | 4B | 26.000 | 28B | 31 (NGL-OIL) | 30 (CRUDE) |
|---|---|---|---|---|---|
| Temperature [F.] | 77.836 | −33.688 | 90.000 | 60.000 | 60.000 |
| Pressure [psig] | 906.000 | 400.000 | 300.000 | 495.000 | 500.000 |
| Molar Flow [lbmole/hr] | 25,804.103 | 2,061.687 | 0.000 | 2,061.676 | 0.000 |
| Viscosity [cP] | 0.013 | 0.179 | | 0.106 | 39.959 |
| Comp Mole Frac (H2O) | 0.000 | 0.000 | 0.000 | 0.000 | 0.000 |
| Comp Mole Frac (Nitrogen) | 0.000 | 0.000 | 0.000 | 0.000 | 0.000 |
| Comp Mole Frac (CO2) | 0.007 | 0.003 | 0.003 | 0.003 | 0.000 |
| Comp Mole Frac (H2S) | 0.000 | 0.000 | 0.000 | 0.000 | 0.000 |
| Comp Mole Frac (Methane) | 0.873 | 0.010 | 0.010 | 0.010 | 0.000 |
| Comp Mole Frac (Ethane) | 0.071 | 0.380 | 0.380 | 0.380 | 0.000 |
| Comp Mole Frac (Propane) | 0.029 | 0.355 | 0.355 | 0.355 | 0.001 |
| Comp Mole Frac (i-Butane) | 0.005 | 0.062 | 0.062 | 0.062 | 0.001 |
| Comp Mole Frac (n-Butane) | 0.010 | 0.127 | 0.127 | 0.127 | 0.001 |
| Comp Mole Frac (i-Pentane) | 0.002 | 0.022 | 0.022 | 0.022 | 0.007 |

TABLE 1B-continued

| Stream Name | 4B | 26.000 | 28B | 31 (NGL-OIL) | 30 (CRUDE) |
|---|---|---|---|---|---|
| Comp Mole Frac (n-Pentane) | 0.003 | 0.042 | 0.042 | 0.042 | 0.045 |
| Comp Mole Frac (C6*) | 0.000 | 0.000 | 0.000 | 0.000 | 0.004 |
| Comp Mole Frac (C7*) | 0.000 | 0.000 | 0.000 | 0.000 | 0.850 |

The results from the simulation of TABLE 1B in connection with FIG. 1 can be tabulated as follows:

| EXAMPLE 1B RESULTS | | |
|---|---|---|
| C2 RECOVERY | 42.63 | |
| C3 RECOVERY | 96.90 | |
| FEED C1 MFR | 0.8725 | |
| CRUDE FEED API | 19.65 | API_60 |
| CRUDE VOL FLOW | 0 | barrel/day |
| CRUDE VISCO | 39.9588 | cP |
| PROD API | 151.0 | API_60 |
| PROD VISCO | 0.1056 | cP |
| PROD FLOW | 12126 | barrel/day |
| VOL FR C1-PROD | 0.0057 | |

The characteristics for stream 31 NGL-OIL from the simulation of TABLE 1B in connection with FIG. 1 can be tabulated as follows:

| EXAMPLE 1B 31 (NGL-OIL) | |
|---|---|
| 60.00 | ° F. |
| 495.0 | psig |
| 334.8 | psig |
| 0.1056 | cP |

The characteristics for stream 30 crude from the simulation of TABLE 1B in connection with FIG. 1 can be tabulated as follows:

| EXAMPLE 1B 30 (CRUDE) | |
|---|---|
| 60.00 | ° F. |
| 500.0 | psig |
| −12.16 | psig |
| 0.0000 | barrel/day |
| −11.63 | psig |
| 39.96 | cP |
| 19.65 | API_60 |

TABLE 1B (in conjunction with the process flow diagram of FIG. 1) shows NGL high C2+ recovery mode with no use of a demethanizer column for polishing recovery in stream nor input of crude oil. TABLE 1B shows NGL recovery with no column polishing. TABLE 1B—<1% (rounded) C1 in the raw NGL product. No use of polishing column 90. This example shows the effectiveness of the present invention without use of demethanizer column 90: C2 recovery 42.62%; C3 recovery 96.90%. TABLE 1B shows the straight achievement of demethanizing, using the process of the present invention.

By way of summary of TABLE 1B in connection with FIG. 1, there is no oil added. There is no column used. Using some of the variability of the system functions to produce NGL already meeting NGL Spec for C1=/<0.5 Vol. (~1% C1 Mole). In this example, there is no flow of Crude Oil Stream (0.000 "Molar Flow" flow in "30 (CRUDE)"). Stream "31 (NGL-OIL)" is (either) just the NGL product (or blended with oil final product either as):

Straight from the inventive process (called raw NGL and as in Stream 26)

(In this case, C1 content is already approximately =/<1 mol %)

or (N/A Diverted) via Stream 28B to a polishing/column facility 90 (a de-methanizer column or other facility) producing NGL product of required specifications (e.g. in this case <1% Mole C1).

Overall Performance accomplished:

C2 Recovery of 43%

C3+ Recovery of 97%+

NGL Product demethanized to <0.5% vol. C1 and not using column facility.

(N/A in this example). Blended with Oil (N/A in this example). Blending with crude oil for any number of purposes e.g. but not limited to:

Modifying Crude Oil viscosity From X cP to Z cp)

Blending (Spiking) as a recovered product from gas stream.

TABLE 1C

| Stream Name | 4B | 26 | 28B | 31 (NGL-OIL) | 30 (CRUDE) |
|---|---|---|---|---|---|
| Temperature [F.] | 77.836 | −33.688 | 90.000 | 60.000 | 60.000 |
| Pressure [psig] | 906.000 | 400.000 | 300.000 | 495.000 | 500.000 |
| Molar Flow [lbmole/hr] | 25,804.103 | 2,061.687 | 0.000 | 17,061.676 | 15,000.000 |
| Liq Mass Density @Std Cond [API_60] | | 150.965 | 150.965 | 25.616 | 19.652 |
| Viscosity [cP] | 0.013 | 0.179 | | 22.557 | 39.959 |
| Comp Mole Frac (H2O) | 0.000 | 0.000 | 0.000 | 0.000 | 0.000 |
| Comp Mole Frac (Nitrogen) | 0.000 | 0.000 | 0.000 | 0.000 | 0.000 |
| Comp Mole Frac (CO2) | 0.007 | 0.003 | 0.003 | 0.000 | 0.000 |
| Comp Mole Frac (H2S) | 0.000 | 0.000 | 0.000 | 0.000 | 0.000 |
| Comp Mole Frac (Methane) | 0.873 | 0.010 | 0.010 | 0.001 | 0.000 |
| Comp Mole Frac (Ethane) | 0.071 | 0.380 | 0.380 | 0.046 | 0.000 |
| Comp Mole Frac (Propane) | 0.029 | 0.355 | 0.355 | 0.043 | 0.001 |
| Comp Mole Frac (i-Butane) | 0.005 | 0.062 | 0.062 | 0.008 | 0.001 |
| Comp Mole Frac (n-Butane) | 0.010 | 0.127 | 0.127 | 0.017 | 0.001 |
| Comp Mole Frac (i-Pentane) | 0.002 | 0.022 | 0.022 | 0.009 | 0.007 |

TABLE 1C-continued

| Stream Name | 4B | 26 | 28B | 31 (NGL-OIL) | 30 (CRUDE) |
|---|---|---|---|---|---|
| Comp Mole Frac (n-Pentane) | 0.003 | 0.042 | 0.042 | 0.045 | 0.045 |
| Comp Mole Frac (C6*) | 0.000 | 0.000 | 0.000 | 0.004 | 0.004 |
| Comp Mole Frac (C7*) | 0.000 | 0.000 | 0.000 | 0.747 | 0.850 |

The results from the simulation of TABLE 1C in connection with FIG. 1 can be tabulated as follows:

| EXAMPLE 1C RESULTS | | |
|---|---|---|
| C2 RECOVERY | 42.62 | |
| C3 RECOVERY | 96.90 | |
| FEED C1 MFR | 0.8725 | |
| CRUDE FEED API | 19.65 | API_60 |
| CRUDE VOL FLOW | 103682 | barrel/day |
| CRUDE VISCO | 39.9588 | cP |
| PROD API | 25.62 | API_60 |
| PROD VISCO | 22.5570 | cP |
| PROD FLOW | 114518 | barrel/day |
| VOL FR C1-PROD | 0.0006 | |

The characteristics for stream 31 NGL-OIL from the simulation of TABLE 1C in connection with FIG. 1 can be tabulated as follows:

| EXAMPLE 1C 31 (NGL-OIL) | |
|---|---|
| 60.00 | ° F. |
| 495.0 | psig |
| 44.38 | psig |
| 22.5570 | cP |
| 25.62 | API_60 |

The characteristics for stream 30 crude from the simulation of TABLE 1B in connection with FIG. 1 can be tabulated as follows:

| EXAMPLE 1C 30 (CRUDE) | |
|---|---|
| 60.00 | ° F. |
| 500.0 | psig |
| −12.16 | psig |
| 1.037e+005 | barrel/day |
| −11.63 | psig |
| 39.96 | cP |
| 19.65 | API_60 |

TABLE 1C (in conjunction with the process flow diagram of FIG. 1) shows NGL lower C2+ recovery mode with no use of a demethanizer column for polishing in stream, and utilizing modifying action on crude oil. This example shows viscosity modification of heavy crude oil using recovered NGL to modify API and Viscosity of the heavy oil. TABLE 1C provides additional results when blending with oil—i.e. viscosity modification, etc. TABLE 1C shows NGL recovery with no column polishing i.e. TABLE 1C—<1% (rounded) C1 in the raw NGL product. No use of column. This illustrates the effectiveness of the present invention without use of demethanizer column and effectively specifically providing product for adding to Crude oil/Hydrocarbon Stream. And, this is used as an example for the direct Oil/fluid blending case above and shown in further detail in TABLE 1C (in connection with FIG. 1) and the process has many common features for other embodiments of this invention.

By way of summary of TABLE 1C in connection with FIG. 1, in this example, the product is blended to oil. The oil viscosity is thereby modified. There is no use of the column. Using some of the variability of the present system functions to produce NGL already meeting NGL Spec for C1=/<0.5 Vol. (~1% C1 Mole). In this example, yes, there is a flow of crude oil stream (15,000 lbmole/hr "Molar Flow" flow in "30 (CRUDE)"). Stream "31 (NGL-OIL)" is (either just the NGL product or) blended with oil final product either as):

(N/A Straight from the inventive process (called raw NGL and as in Stream 26)

(and in this case, C1 content is ALREADY approximately =/<1% mol %)

OR)

(N/A Diverted) via Stream 28B to a polishing/column facility 90 (a de-methanizer column or other facility) producing NGL Product of required specifications (e.g. in this case <1% Mole C1).

Overall Performance accomplished:

C2 Recovery of 43%

C3+ Recovery of 97%+

NGL Prod demethanized using system to <0.5% vol. C1 and not using column facility.

Blended with Oil

Blending with crude oil for any number of purposes e.g. but not limited to:

Modifying Crude Oil viscosity From 40 cP to 23 cP

Blending (Spiking) as a recovered product from gas stream.

TABLE 2

| | Stream Name | | | | | | | |
|---|---|---|---|---|---|---|---|---|
| | 1 (LEAN) | 2 (RICH) | 3 (MID) | 4A | 4B | 5 | 6 | 8 |
| Temperature [F.] | 110.0000 | 100.0000 | 100.0000 | 100.0000 | 77.8360 | −70.0000 | −187.4702 | −160.0881 |
| Pressure [psig] | 916.0000 | 916.0000 | 916.0000 | 916.0000 | 906.0000 | 901.0000 | 50.0000 | 50.0000 |
| Molar Flow [lbmole/hr] | 25,804.1030 | 0.0000 | 0.0000 | 25,804.1030 | 25,804.1030 | 25,804.1030 | 25,804.1030 | 28,460.3862 |

| | Stream Name | | | | | | | |
|---|---|---|---|---|---|---|---|---|
| | 9 | 10 | 11 | 12 | 12A | 13 | 15 | 15A |
| Temperature [F.] | −160.0881 | −160.0881 | 72.8359 | 459.5196 | 100.0000 | −160.0881 | −156.0241 | −156.0241 |
| Pressure [psig] | 50.0000 | 50.0000 | 45.0000 | 500.0000 | 495.0000 | 50.0000 | 650.0000 | 650.0000 |

TABLE 2-continued

| | | | | | | | | |
|---|---|---|---|---|---|---|---|---|
| Molar Flow [lbmole/hr] | 23,738.4486 | 23,738.4486 | 23,738.4486 | 23,738.4486 | 23,738.4486 | 4,721.9377 | 3,305.3564 | 1,416.5813 |

| | Stream Name | | | | | | | |
|---|---|---|---|---|---|---|---|---|
| | 15C | 15D | 15E | 15X | 15Y | 16 | 17 | 18 |
| Temperature [F.] | −156.0241 | −156.0241 | −156.0241 | −154.4029 | −154.4029 | −154.0590 | 14.7676 | −36.6742 |
| Pressure [psig] | 650.0000 | 650.0000 | 650.0000 | 400.0000 | 400.0000 | 55.0000 | 50.0000 | 50.0000 |
| Molar Flow [lbmole/hr] | 0.0000 | 1,416.5813 | 0.0000 | 1,416.3345 | 0.0000 | 3,305.3564 | 3,305.3564 | 4,974.0924 |

| | Stream Name | | | | | | | |
|---|---|---|---|---|---|---|---|---|
| | 19 | 20 | 21A | 21B | 22A | 22B | 23 | 24 |
| Temperature [F.] | 100.0000 | 40.8402 | 28.6105 | 28.6105 | 28.6102 | 28.6102 | 28.6102 | −36.6750 |
| Pressure [psig] | 950.0000 | 400.0000 | 400.0000 | 400.0000 | 400.0000 | 400.0000 | 400.0000 | 50.0000 |
| Molar Flow [lbmole/hr] | 4,970.3721 | 4,970.3721 | 2,656.2833 | 0.0000 | 0.0000 | 0.0000 | 3,730.4233 | 2,061.6873 |

| | Stream Name | | | | | | | |
|---|---|---|---|---|---|---|---|---|
| | 25 | 26 | 27A | 27B | 27C | 28 | 28A | 28B |
| Temperature [F.] | −33.6880 | −33.6880 | −33.6880 | −33.6880 | −33.6880 | 90.0000 | 90.0001 | 90.0001 |
| Pressure [psig] | 400.0000 | 400.0000 | 400.0000 | 400.0000 | 400.0000 | 300.0000 | 300.0000 | 300.0000 |
| Molar Flow [lbmole/hr] | 2,061.6873 | 2,061.6873 | 0.0000 | 2,061.6873 | 0.0000 | 2,061.6764 | 2,061.6764 | 0.0000 |

| | Stream Name | | | |
|---|---|---|---|---|
| | 28C | 29 | 30 (CRUDE) | 31 (NGL-OIL) |
| Temperature [F.] | −244.0323 | 164.8690 | 60.0000 | 60.0000 |
| Pressure [psig] | 300.0000 | 300.0000 | 500.0000 | 495.0000 |
| Molar Flow [lbmole/hr] | 0.0000 | 0.0000 | 15,000.0000 | 17,061.6764 |

Referring to TABLE 2, there is displayed temperature, pressure and flow characteristics of the various streams referenced in connection with FIG. 1 and TABLE 1C.

In another example, non-optimized recoveries from a gas at 500 psig range as follows: For rich gas (37% C1), the C3 recovery is 98%, the C2 recovery is 75%. For lean gas (88% C1), the C3 recovery is 95%, the C2 recovery is 42%. In an optimized system, C2 recoveries in an optimized configuration can be up to 90+% and C3 recoveries can be up to about 100%. This optimized configuration involves modifications to the basic process steps (c) through (e): (c) further cooling the feed stream from the heat exchanger via a first gas expansion assembly; (d) separating the further cooled stream in a first gas/liquid separation vessel assembly into gas and liquid streams; and (e) pumping the liquid stream (0-100%) from the first separation vessel assembly into the heat exchanger to impart a cooling effect on the feed stream in the heat exchange. In this modified process, stream 5 is directed through a turbo expander, then the discharge from the turbo expander is separated into liquid and gas phases. The liquid phase is directed as per stream 13. The gas phase is directed through another turbo expander whos discharge is directed into another separator. The liquid from separation after second turbo expansion is directed as per stream 13, the gas as per stream 9.

In view of the above, it is contemplated an NGL recovery process that can be used directly or indirectly to enhance heavy crude oil processes and/or handling as shown in this embodiment. It is contemplated a novel NGL recovery process. It is contemplated a novel NGL recovery process with/without a novel demethanizing method. It is contemplated a novel demethanizing process for NGL recovery process(es). It is contemplated of further embodiments to accompany and show an NGL recovery process with various contemplations. It is contemplated an NGL/less-volatile components recovery process from fluid streams. It is contemplated an NGL recovery process with or without a demethanizer/fractionation/distillation column. It is contemplated an NGL deep recovery process with JT valve expansion only. It is contemplated an NGL deep recovery process with JT and/or turboexpansion expansion cooling process. It is contemplated a $CO_2$ tolerant NGL recovery process. It is contemplated a deep extraction NGL recovery process with recovery of C2+. It is contemplated a deep extraction NGL recovery process with rejection of C2+. It is contemplated an NGL recovery process pre-LNG pretreatment.

It is contemplated an NGL recovery process post-LNG manufacture at receiving end with and/or LNG gasification steps. It is contemplated an NGL recovery and LNG gasification process. It is contemplated an NGL recovery process with low pressure source feed gas. It is contemplated an NGL recovery process with high pressure source feed gas. It is contemplated an NGL recovery process with external refrigeration. It is contemplated an NGL recovery process without external refrigeration. It is contemplated an NGL recovery process to handle rich in less volatile content gases/fluids. It is contemplated an NGL recovery process to handle lean in less volatile content gases/fluids. It is contemplated an NGL recovery process and pipeline specification or pumping criteria or pressure drop or multiphase criteria meeting mix of the NGL or its mixing with other process fluids, as in one example of crude oil liquids. It is contemplated an NGL recovery process meeting some $CO_2$ process stream requirements in either rejection or separation of $CO_2$ from NGL stream. It is contemplated the contemplated and other incidental benefits of this novel NGL and demethanizing process different from the technologies of current art form.

The present invention is directed to the process or method or system or improvements whichever applies to comprising any feature described, either individually or in combination with any feature, in any configuration or individual steps or processes or combination of individual steps or processes for equipment design, operating, separating or recovering components of varying volatilities from natural gas (LNG) or any other mix of hydrocarbons or other fluid mixes in a fluid phase.

The present invention provides an unconventional process to vary hydrocarbon compositions in various streams.

The present invention includes a process for separating less volatile hydrocarbons from more volatile hydrocarbons; and not limited to but more particularly less volatile hydrocarbons from gas streams with more volatile hydrocarbon components;

The invention is also directed to NGL components from lean in NGL components hydrocarbon gas.

The present invention is used to produce essentially stabilized condensate, one condensate being NGL, one NGL being variable in ethane (C2) component, the C2 component being varied to produce NGL with "Ethane Extraction" or "Ethane Rejection" based C2 amounts The current invention provides a process of unconventional means to separate less volatile hydrocarbons from more volatile hydrocarbons. This process is particularly not dependent on degrees of freedom of a process predominantly tied to a conventional column.

The process is not tied to use of conventional column to extract NGL from hydrocarbon fluid stream(s).

The process is not tied to use of conventional column to essentially extract NGL with Ethane Extraction or Ethane Rejection function.

The present invention also describes a process for producing Pipeline Specification NGL (or condensate); a process for producing demethanized NGL (or condensate); a process for producing demethanized NGL (or condensate) for crude oil enhancement; a process for introducing demethanized NGL (or condensate) of suitable TVP to liquid hydrocarbon carrying pipelines; a process for providing product for improving performance of hydrocarbon carrying pipelines, in one instance more particularly reducing potential of multiphase (gas and liquid(s)) flow pipelines to that of essentially liquid(s) flow regime flow lines; in another instance more particularly reducing potential of high viscosity flow lines to lower viscosity flow performing flow lines.

The invention also includes a process essentially introducing process steps providing complete desired hydrocarbon separation process; a process essentially introducing process steps to enhance hydrocarbon separation process(es).

The invention is also directed to a process essentially introducing process steps suitable for improving process of conventional hydrocarbon processes and not limited to; more particularly NGL separation processes; more particularly a $CO_2$ tolerant process; more particularly Ethane Extraction Processes; more particularly Ethane Rejection Processes; more particularly process stream product Heating Value control processes; more particularly product hydrocarbon component variation processes; more particularly product demethanizing processes;

Also disclosed is a process essentially introducing process steps suitable for particularly specific component hydrocarbon separation processes.

Additionally, the present disclosure also teaches a process essentially introducing process steps suitable with or to conventional hydrocarbon separation processes; in one instance particularly introducing means of providing product feed stream changing effectiveness/capacity of conventional NGL extraction process with column; in one instance particularly introducing means of providing process streams for integration with conventional hydrocarbon extraction process(es) with column(s); in one instance particularly using a conventional column (or columns) as an additional step to process; in one instance more particularly using conventional column (or columns) to polish a product stream.

The present disclosure further provides a process providing means of introducing a less process utilities demanding and/or less process equipment capacity demanding feed stream for processing.

The present disclosure is also directed to a process for separating less volatile hydrocarbons from more volatile hydrocarbons; and not limited to but more particularly heavier hydrocarbons from gas streams with lighter hydrocarbon components; and more particularly NGL components from lean in NGL components hydrocarbon gas; producing essentially stabilized condensate; more particularly condensate being NGL; more particularly NGL being variable in Ethane (C2) component; more particularly C2 component being varied to produce NGL with "Ethane Extraction" or "Ethane Rejection" based C2 amounts; particularly unconventional process to vary hydrocarbon compositions in various streams; more particularly a process of unconventional means to separate less volatile hydrocarbons from more volatile hydrocarbons; more particularly a process of unconventional means to separate C2+ less volatile hydrocarbons from more volatile hydrocarbons; more particularly not dependent on degrees of freedom of process predominantly tied to a conventional column; more particularly not tied to use of conventional column to extract NGL from hydrocarbon fluid stream(s); more particularly not tied to use of conventional column to essentially extract NGL with Ethane Extraction or Ethane Rejection function.

The present disclosure also provides a process for producing Pipeline Specification NGL; a process for producing demethanized NGL; a process for producing demethanized NGL for crude oil enhancement; a process for introducing demethanized NGL of suitable TVP to liquid hydrocarbon carrying pipelines; a process for improving performance of hydrocarbon carrying liquid pipelines; in one instance more particularly reducing potential of multiphase flow pipelines to that of essentially liquids flow regime flow lines; in another instance more particularly reducing potential of high viscosity flow lines to lower viscosity flow performing flow lines; a process essentially introducing process steps providing complete desired hydrocarbon separation process; a process essentially introducing process steps to enhance hydrocarbon separation process(es); a process essentially introducing process steps suitable for improving process of conventional hydrocarbon processes; more particularly NGL separation processes; more particularly Ethane Extraction Processes. more particularly Ethane Rejection Processes; more particularly de-methanizing Processes; more particularly specific component hydrocarbon separation Processes; a process to help increase NGL processing capacity of NGL extraction facilities; a process that reduces methane content of gas condensates; a process that can reduce more volatile component content of product streams in hydrocarbon processes; process steps that can reduce more volatile component content of product streams in hydrocarbon process(es).

The present disclosure also pertains to a process and process steps for separation of hydrocarbons; a process and process steps of manipulating process equilibrium thermodynamics; A process and process steps of selective enhancement of hydrocarbon components in product streams; A process and process steps for almost infinitely varying compositions of hydrocarbon mixtures to obtain preferred shifts of hydrocarbon mixture components; A process and process steps for preferentially shifting hydrocarbon component concentrations within process; A process and process steps for preferentially shifting hydrocarbon component concentrations to produce desired end product specifications; process not limited to but providing more particularly in this case means to separate at least methane from hydrocarbon(s) less volatile than methane; more particularly in this one case into a product stream with methane lean in hydrocarbon(s) less volatile than methane and other hydrocarbon product(s) lean in methane and enriched with hydrocarbon(s) less volatile than methane; more particularly in this case considered a NGL extraction process; more particularly in this case a demethanizing process; more particularly process providing available variability or choice to extract NGL with Ethane extraction; more particularly process providing available variability or choice to extract NGL with Ethane rejection; comprising the step parameters (pressures, temperatures, flows) more specifically provided by Table 2 that one versed in the art can replicate:

(a) a Feed Stream is cooled in heat exchanger(s) and expanded resulting in further cooling by Joule Thompson effect, and the resulting equilibrium stream(s) separated into gas and liquid;

(b) (0 to 100%) of the liquid stream(s) obtained in step (a) is supplied to cool Feed stream(s) of step (a);

(c) (0 to 100%) of the gas stream(s) obtained in step (a) is supplied to cool Feed stream(s) of step (a);

(d) other (0 to 100%) of liquid stream(s) of step (b) and possible splits thereof is (are) sent to meet other steps downstream or upstream of the point to meet variability of the inventive process being disclosed;

(d) Liquid stream of step (b) provides cooling to Feed Stream of step (a) and in the process warms up;

(e) Stream of step (d) is separated into equilibrium streams of gas and liquid;

(f) gas stream of step (e) is compressed and cooled into cooled compressed stream;

(g) compressed stream of step (f) is expanded to cool and separated into equilibrium streams of gas and liquid;

(h) (0-100%) variable of gas stream of step (g) is sent to mix with equilibrium mix of step (a);

(i) (0-100%) variable of liquid stream of step (g) is sent to mix with equilibrium mix of step (a);

(j) other (0-100%) variable of gas stream of step (g) is sent to other downstream process(es);

(k) other (0-100%) variable of liquid stream of step (g) is sent to other downstream process(es);

(l) other (0-100%) variable of liquid stream of step (g) is sent to mix with equilibrium mix of step (e);

(m) liquid stream of step (e) is pressurized and sent to produce a mix with streams of step (j) and step (k);

(n) (0-100%) variable of stream of step (m) is sent to other downstream end product NGL or other liquids property modification process;

(o) other (0-100%) variable of stream of step (m) is sent to impart cooling to Feed stream of step (a) and warming up in the process;

(p) other (0-100%) variable of stream of step (m) is sent to other downstream process(es);

(q) Stream of step (p) is combined with warmed stream of step (o);

(r) (0-100%) variable of stream of step (q) is sent to other downstream end product NGL or other liquids property modification process;

(s) other (0-100%) variable of stream of step (r) is sent to other downstream process for further refining or separation resulting in at least one product such as NGL for example;

(t) stream of step (s) is sent to other downstream end product NGL or other liquids property modification process of step;

(u) streams of step (t), step (s) and (n) are processed or mixed with other process streams such as particularly in application of this process with crude oil (often heavy) producing a preferred product content (such as amounts of NGL ethane-plus components) or preferred product property (transport phenomenon or flowing properties).

The present disclosure provides an unconventional columnless demethanizing broad "composition swing methodology" and is envisioned that it can be applied to other hydrocarbons.

The process provides the ability to shift up/down/sideways concentrations of hydrocarbons driven by equilibrium for or to preferred separations points. Side streams can also be taken out as products.

As one particular specific example of the process (without use of column 90) permits recovering ~97% C3 fractions and ~43% C2+ fraction and still with a (TVP=~335 psig, C1 Vol %=~0.5%) and all ready-made to go into pipeline since it should meet pipeline specs (TVP<600 psig, C1 Vol %<0.5%).

Especially when blended to oil it is a huge benefit to the oil industry in that pumping not required to keep a pipeline pressure of more than 400 PSIG with large recovery of NGL's from Oil/Gas fields.

The process provides many available variables, for example, with use of step changes and use of turbo-expander units one can achieve ~73% C2 recovery with ~100% C3+ recovery with C1<1% vol and TVP of 371 psig.

Any person skilled in the art or science, particularly one who is used to process engineering skills will, having had the benefit of the present disclosure, recognize many modifications and variations to the specific embodiment(s) disclosed. As such, the present disclosure, including examples, should not be used to limit or restrict the scope of the invention or their equivalents. Although embodiments have been shown illustrating operation of the processes of the present disclosure, those of ordinary skill in the art having the benefit of this disclosure could create other alternative embodiments that are within the scope of this invention. For example, with the benefit of the present disclosure, those of ordinary skill in the art will appreciate and understand that modifications and alternative embodiments to the process or method or system or improvements disclosed herein and comprise any feature described, either individually or in combination with any feature, in any configuration or individual steps or processes or combination of individual steps or processes for equipment design, operating, separating or recovering components of varying volatilities from Liquefied Natural Gas (LNG) or any other mix of hydrocarbons or other fluid mixes in a fluid phase.

The present invention will also find utility when used in connection with oil/stream/product enhancement. For example, the present invention could be used to increase pipeline capacities.

All references referred to herein are incorporated herein by reference as providing teachings known within the prior art. While the apparatus and methods of this invention have been described in terms of preferred embodiments, it will be apparent to those of skill in the art that variations may be applied to the process and system described herein without departing from the concept and scope of the invention. All such similar substitutes and modifications apparent to those skilled in the art are deemed to be within the scope and concept of the invention. Those skilled in the art will recognize that the method and apparatus of the present invention has many applications, and that the present invention is not limited to the representative examples disclosed herein. Moreover, the scope of the present invention covers conventionally known variations and modifications to the system components described herein, as would be known by those skilled in the art. While the apparatus and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

We claim:

1. A process for separating less volatile hydrocarbons from more volatile hydrocarbons while also producing stabilized condensates or NGL, comprising the steps of:

a. providing a pressurized feedstock stream comprising hydrocarbons;

b. directing the feedstock stream as a feed stream to a heat exchanger and then cooling the feed stream in the heat exchanger;

c. further cooling the feed stream from the heat exchanger via a first gas expansion assembly;

d. directing the further cooled stream from the first gas expansion assembly to a first gas/liquid mixer and separation vessel assembly and separating the further cooled stream into gas and liquid streams, wherein the first gas/liquid mixer and separation vessel assembly is capable of receiving one or more recycle streams from one or more downstream processing steps;

e. directing the liquid stream from the first gas/liquid mixer and separation vessel assembly to a splitter pump capable of directing fractions of the liquid stream from the splitter pump to the heat exchanger and to a third stream splitter;

f. recycling a fraction of the liquid stream from the splitter pump into the heat exchanger to provide cooling to the feed stream in the heat exchanger, and directing the balance of the liquid stream from the first gas/liquid mixer and separation vessel assembly to the third stream splitter;

g. recycling the gas stream from the first gas/liquid mixer and separation vessel assembly into the heat exchanger to impart additional cooling in the heat exchanger;

h. directing the recycled gas stream from the heat exchanger to a first compressor cooler assembly, and then compressing and cooling the recycled gas stream for use at an end location;

i. directing the recycled liquid stream from the heat exchanger to a second separation vessel assembly wherein gas and liquid are separated;

j. directing the gas stream from the second separation vessel assembly to a second compressor cooler assembly and compressing the gas stream from the second separation vessel assembly;

k. cooling the gas stream from the second compressor cooler assembly via a second gas expansion assembly;

l. directing the cooled stream from the second gas expansion assembly to a third separation vessel assembly wherein gas and liquid are separated, wherein the third separation vessel assembly is capable of directing fractions of the liquid stream in the third separation vessel assembly to the first gas/liquid mixer and separation vessel assembly, a first stream mixer splitter assembly, and/or the second separation vessel assembly, and wherein the third separation vessel assembly is capable of directing fractions of the gas stream (totaling 100%) in the third separation vessel assembly to the first gas/liquid mixer and separation vessel assembly and/or to the first stream mixer splitter assembly;

m. directing a fraction of the gas stream from the third separation vessel assembly to the first gas/liquid mixer and separation vessel assembly;

n. directing a fraction of the gas stream from the third separation vessel assembly to the first stream mixer splitter assembly;

wherein the combined fractions of step m. and step n. total 100%;

o. directing a desired fraction of the liquid stream from the third separation vessel assembly to the first gas/liquid mixer and separation vessel assembly;

p. directing a desired fraction of the liquid stream from the third separation vessel assembly to the first stream mixer splitter assembly;

q. directing a desired fraction of the liquid stream from the third separation vessel assembly to the second separation vessel assembly;

wherein the combined fractions of step o., step p. and step q. total 100%;

r. pumping the liquid stream from the second separation vessel assembly to the first stream mixer splitter assembly;

s. directing a first fraction of a stream from the first stream mixer splitter assembly to a mixing blender or other end location;

t. directing a fraction of the stream from the first stream mixer splitter assembly to a second stream mixer splitter assembly;

u. directing a first fraction of a stream from the second stream mixer splitter assembly to the mixing blender or other end location;

v. pumping the fraction of the liquid stream from the first gas/liquid mixer and separation vessel assembly to the third stream splitter via the splitter pump, the third stream splitter capable of directing fractions of the liquid stream from the third stream splitter to the first gas/liquid mixer and separation vessel assembly, a fourth stream splitter, and/or to an end location;

w. directing a first fraction of a liquid stream from the third stream splitter to the first gas/liquid mixer and separation vessel assembly;

x. directing a second fraction of the liquid stream from the third stream splitter to the fourth stream splitter, the fourth stream splitter being capable of directing fractions of a liquid stream from the fourth stream splitter to the third separation vessel assembly and/or the second separation vessel assembly;

y. directing a third fraction of the liquid stream from the third stream splitter to an end location;

wherein the combined fractions of step w., step x. and step y. total 100%;

z. directing a first fraction of the liquid stream from the fourth stream splitter to the third separation vessel assembly;

aa. directing a second fraction of the liquid stream from the fourth stream splitter to the second separation vessel assembly;

wherein the combined fractions of step z. and step aa. total 100%; and bb. directing a stream from the mixing blender to an end location.

2. The process of claim 1 wherein the hydrocarbon feedstock stream comprises a hydrocarbon-containing gas.

3. The process of claim 2 wherein the hydrocarbon feedstock stream comprises natural gas.

4. The process of claim 1 wherein the feed stream is pre-cooled in a pre-cooling assembly prior to the step of cooling in the heat exchanger.

5. The process of claim 4 comprising the further steps of first directing a third fraction of the stream from the first stream mixer splitter assembly to the pre-cooling assembly to provide a cooling duty to the pre-cooling assembly and then directing the third fraction of the stream from the first stream mixer splitter assembly to the second stream mixer splitter assembly.

6. The process of claim 4 wherein the pre-cooling assembly obtains its cooling duty from an external refrigeration source.

7. The process of claim 1 wherein the heat exchanger comprise one or more heat exchangers operating together.

8. The process of claim 1 wherein the steps of expansion are accomplished using expansion devices selected from the group consisting of: valves, turbo expanders, vortex devices, and sonic devices.

9. The process of claim 1 comprising the further steps of: (i) directing a second fraction of the stream from the second stream mixer splitter assembly to one or more process columns; (ii) processing the second fraction of the stream from the second stream mixer splitter assembly stream in the one or more process columns; (iii) directing a processed product liquid stream from the one or more process columns to the mixing blender or other end location; and (iv) directing any residue streams from the one or more process columns to an end location.

10. The process of claim 1 comprising the further steps of: (i) introducing a source of crude oil or other liquid hydrocarbons into the mixing blender; and (ii) blending the crude oil with the liquids from the process that are present in the mixing blender.

11. The process of claim 1 wherein the feedstock stream is pressurized to between 300 psig to 1200 psig.

12. The process of claim 1 wherein the feedstock stream is pressurized to 500 psig.

13. The process of claim 1 wherein the first gas expansion assembly comprises a first turbo expander, the process comprising the additional steps of: after the step of separating the further cooled stream in the first gas/liquid mixer and separation vessel assembly into gas and liquid streams, directing the gas stream into a second turbo expander, and then separating the stream from the second turbo expander into an additional gas stream and an additional liquid stream, the additional liquid stream being directed to the splitter pump, the additional gas stream being directed back to the heat exchanger.

14. The process of claim 1 wherein the pressurized feedstock stream comprises C1, C2, C3+.

15. The process of claim 1 wherein the pressurized feedstock stream comprises C1, C2, C3, C4, C5, C6, and C7.

* * * * *